US006570301B1

(12) United States Patent
Hishinuma et al.

(10) Patent No.: US 6,570,301 B1
(45) Date of Patent: May 27, 2003

(54) DIELECTRIC BARRIER DISCHARGE LAMP DEVICE WITH COUPLER FOR COOLANT FLUID FLOW

(75) Inventors: Nobuyuki Hishinuma, Himeji (JP); Shinji Sugioka, Kakogawa (JP); Satoru Fukuda, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/537,715

(22) Filed: Mar. 30, 2000

(30) Foreign Application Priority Data

Mar. 30, 1999 (JP) ..... 11-088283

(51) Int. Cl.[7] ..... H01J 61/52; H01J 7/26; H01K 1/58

(52) U.S. Cl. ..... 313/36; 313/25; 313/607; 313/609; 315/246; 315/248

(58) Field of Search ..... 313/25, 607, 634, 313/234, 485, 570–573, 35, 609, 34–36; 315/246, 248, 335

(56) References Cited

U.S. PATENT DOCUMENTS 4,945,290 A 7/1990 Eliasson et al.
5,039,904 A * 8/1991 Kosmatka et al. ..... 313/113
5,104,151 A * 4/1992 Adams ..... 285/148.19
5,147,130 A * 9/1992 Watanuki ..... 165/104.32
5,194,740 A * 3/1993 Kogelschatz et al. ... 250/432 R
5,834,784 A * 11/1998 Morgan et al. ..... 250/435
5,871,239 A * 2/1999 Boscaljon et al. ..... 285/354
6,294,869 B1 * 9/2001 Adachi et al. ..... 313/234

FOREIGN PATENT DOCUMENTS

JP 07169443 A * 7/1995 ..... H01J/65/04
JP 07288112 A * 10/1995 ..... H01J/65/04
JP 09274893 A * 10/1997 ..... H01J/65/04

* cited by examiner

*Primary Examiner*—Ashok Patel
*Assistant Examiner*—Sikha Roy
(74) *Attorney, Agent, or Firm*—Nixon Peabody LLP; David S. Safran

(57) ABSTRACT

A dielectric-barrier discharge lamp device that can reliably prevent leakage of the coolant fluid used to cool the dielectric-barrier discharge lamp, and that can reliably cool the dielectric-barrier discharge lamp, is achieved by the dielectric-barrier discharge lamp device having a dielectric-barrier discharge lamp (1) with a hollow-cylinder-shaped discharge space (P) formed by an outer tube (3) that is roughly cylindrical in external shape and a co-axial inner tube (2), in which the inner tube (2) has a cylindrical tube extension (2A) that extends outward from the discharge space (4), and in which the outer periphery of the end (2A1) of the tube extension (2A) is held tightly by a coupler fitting (8) connected to a guide tube (11) through which a coolant fluid flows.

6 Claims, 3 Drawing Sheets

DIELECTRIC BARRIER DISCHARGE LAMP DEVICE WITH COUPLER FOR COOLANT FLUID FLOW

BACKGROUND OF THE INVENTION

1. Field of the Invention

This invention concerns a dielectric-barrier discharge lamp device.

2. Description of Related Art

In recent years, technology has developed for treating metals,glass and other materials by illuminating the item to be treated with vacuum ultraviolet radiation at wavelengths up to 200 nm, thus allowing the vacuum ultraviolet radiation and the ozone produced thereby to operate on the item to be treated. Examples are cleaning treatment technology that removes organic pollutants adhered to the surface of the item to be treated, and oxide film formation technology that forms an oxide film on the surface of the item to be treated.

The lamps conventionally used to provide such treatment have been low-pressure mercury lamps that emit vacuum ultraviolet radiation at a wavelength of 185 nm, which is the resonant line of mercury. In recent times, dielectric-barrier discharge lamps have come to be used. These are lamps that produce excimer emissions by containing a gas for excimer emissions in a discharge vessel made up of a dielectric and bringing about a dielectric-barrier discharge (also called "ozonizer discharge" or "silent discharge." See *Discharge Handbook*, Association of Electrical Studies, rev. ed. June 1989, p. 263).

Such dielectric-barrier discharge lamps are described in, for example, U.S. Pat. No. 4,945,290 (Japanese Kokai Patent H1-144560). That patent document describes a dielectric-barrier discharge lamp in which a hollow-cylinder-shaped discharge space, made up of quartz glass of which at least a part is dielectric, is filled with a gas for excimer emissions.

A problem of dielectric-barrier discharge lamps of that type is that the lighting efficiency of the lamp (the ratio of area lighted to input power) decreases as the power input to the lamp is increased. The cause is thought to be that the temperature of the gas in the lamp increases with the input power, and the lighting efficiency decreases as a result.

There is an additional problem in that the increase of gas temperature decreases the transmissivity of the quartz glass. For example, the transmissivity at a wavelength of 172 nm is about 85% at 25° C., but it falls to about 83% at 100° C. and about 73% at 300° C.

There is a further problem in that the increased temperature of the lamp lowers the insulator fracture voltage of the quartz glass, and so it is possible for the lamp to fracture and leak. Depending on the application, it is often necessary to increase the input power in order to raise the light output. For that reason, it becomes necessary to reduce the gas temperature by cooling the lamp itself.

FIG. 3 is an explanatory drawing of a conventional dielectric-barrier discharge lamp device fitted with a cooling mechanism. In the drawing, the discharge lamp 1 has two co-axial tubes, an inner tube 2 and an outer tube 3, forming a hollow-cylinder-shaped discharge space 4 between the inner tube 2 and the outer tube 3. The inner tube 2 and the outer tube 3 are made up of a dielectric, at least in part. For example, the inner tube 2 and the outer tube 3 are made up of quartz glass that allows light at a wavelength of 172 nm to pass.

A roughly cylindrical electrode 5 is placed in close contact with the inner surface of inner tube 2. This internal electrode 5 is made up by joining two half cylinders formed by bending aluminum sheets. Around the outer surface of the outer tube 3 is placed an external electrode 6 that allows the light to pass through it. The external electrode 6 comprises a mesh electrode that allows the passage of ultraviolet light. The internal electrode 5 and external electrode 6 are connected to an alternating current power supply that is not illustrated. An inert gas or a mixture of an inert gas and a halogen is placed in the discharge space 4 as a discharge gas.

At each of the ends 1A and 1B of the dielectric-barrier discharge lamp 1, a ring-shaped gasket 7 is located that has a through-hole 7A and that is aligned with the end 1A, 1B of lamp 1. The diameter of the through-holes 7A is the same as the diameter of the inner space P that is formed by the inner tube 2.

A coupler fitting 8 has the gasket 7 on its inner face; by rotating this coupler fitting 8, the gaskets 7 are pressed against the ends 1A, 1B of the dielectric-barrier discharge lamp 1, creating a tight seal between the gaskets 7 and the ends 1A, 1B. Through-holes 8A are formed in the coupler fittings 8 to align with the through-holes 7A in the gaskets 7.

The coupler fittings 8 are held in casings 9 by O-rings 10. This casing 9 is formed with through-holes 9A aligned to allow the passage of a coolant fluid through through-holes 8A.

In other words, the inner space P formed by the inner tube 2 forms a passage along with the through-holes 8A of the coupler fittings 8 and the through-holes 9A of the casing 9. As indicated by the arrows in FIG. 3, the coolant fluid leaving one side of the casing 9 through through-hole 9A then passes through the through-holes 8A and 7A into the inner space P formed by the inner tube 2, to cool the dielectric-barrier discharge lamp 1 from the inner tube 2.

However, the dielectric-barrier discharge lamp 1 is made by welding together the inner tube 2 and the outer tube 3 in order to form the discharge space 4. For that reason, there will be irregularities where the ends 1A, 1B face gaskets 7. That is, when the gaskets 7 are pushed tightly against the ends 1A, 1B, gaps may be left between the gaskets 7 and the ends 1A, 1B if they are not pushed hard enough, and the coolant fluid is liable to leak from those gaps. Also, there is the problem that, if the coolant fluid leaks, it will not be possible to cool the dielectric-barrier discharge lamp 1.

Moreover, vacuum ultraviolet radiation is emitted by the dielectric-barrier discharge lamp 1, and the gaskets 7 are directly illuminated by that vacuum ultraviolet radiation. As a result, there is also the problem that the gaskets 7 deteriorate because of the vacuum ultraviolet radiation. In addition, gaps occur between the gaskets 7 and the ends 1A, 1B in the course of deterioration of the gaskets 7, causing leakage of the coolant fluid from the gaps. Thus, there is a problem in that it becomes impossible to cool the dielectric-barrier discharge lamp 1 if the coolant fluid leaks.

SUMMARY OF THE INVENTION

A primary object of this invention is to provide a dielectric-barrier discharge lamp device in which leakage of the coolant fluid used to cool the dielectric-barrier discharge lamp can be reliably prevented, and in which the dielectric-barrier discharge lamp can be reliably cooled.

To achieve the object stated above, this invention provides a dielectric-barrier discharge lamp device having a dielectric-barrier discharge lamp with a hollow-cylinder-shaped discharge space formed by an outer tube that is roughly cylindrical in external shape and a co-axial inner tube, in which the inner tube has a cylindrical tube extension that extends outward from the discharge space, and in which the outer periphery of the end of the tube extension is held tightly by a coupler fitting connected to a guide tube through which a coolant fluid flows.

DETAILED DESCRIPTION OF THE INVENTION

Figure 1:
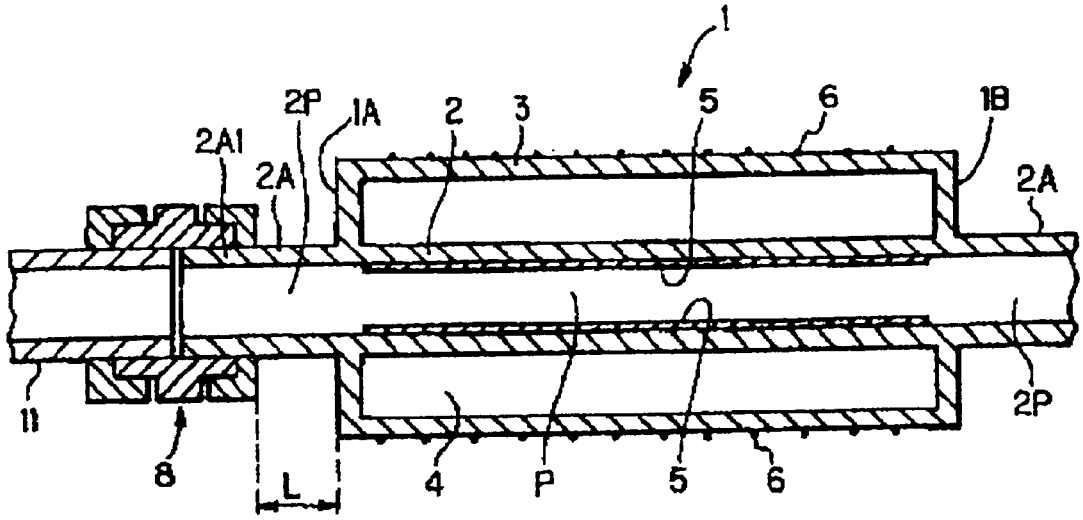
FIG. 1 is a cross-sectional view of the dielectric-barrier discharge lamp device of this invention.

In FIG. 1, a dielectric-barrier discharge lamp device 1 in accordance with the present invention is shown which comprises a co-axial, overlapping structure of an inner tube 2 and an outer tube 3 made of quartz glass, a dielectric that passes light with a wavelength of 172 nm. The ends of the inner tube 2 and the outer tube 3 are welded together to form a hollow-cylinder-shaped discharge space 4.

As for physical dimensions, the inner space P formed by the inner tube 2 has a diameter of 12 to 15 mm, the thickness of the inner tube 2 is 1 mm, the outer diameter of the outer tube 3 is 24 to 27 mm, and the thickness of the outer tube 3 is 1 mm. The length of the discharge space 4 is 260 mm, and the discharge space 4 is filled with xenon, as an inert gas, at a pressure of 3 to 5 KPa.

A part of the inner tube 2 forms a cylindrical tube extension 2A that projects beyond the discharge space 4 formed by the inner tube 2 and the outer tube 3. That is, the central space 2P of tube extension 2A connects with the inner space P. Here, the tube extension 2A comprises a part of the inner tube 2; but it may also be a separate piece welded to the end 1A or 1B of the inner tube 2 in the direction of the axis of the dielectric-barrier discharge lamp 1, such that its central space connects with the inner space P.

A roughly cylindrical electrode 5 is closely adhered to the inner surface of the inner tube 2. This internal electrode 5 can be formed, for example, by joining two half cylinders made by bending aluminum sheet 0.5 mm thick. Around the outer surface of the outer tube 3 is placed an external electrode 6 that allows the light to pass through. This external electrode 6 comprises a mesh electrode that allows the passage of ultraviolet light. The internal electrode 5 and external electrode 6 are connected to an alternating current power supply (not illustrated).

The end 2A1 of the tube extension 2A is attached to a coupler fitting 8, which connects to a guide tube 11 through which the coolant fluid flows. Specifically, the outer periphery of the end 2A1 is held tightly by the coupler fitting 8. The coupler fitting 8 that attaches to the other tube extension 2A is not shown but is the same in construction. The guide tube 11 is an inlet or outlet tube for the coolant fluid, and either projects from or is contained in the casing that holds the dielectric-barrier discharge lamp 1 in place.

Figure 2:
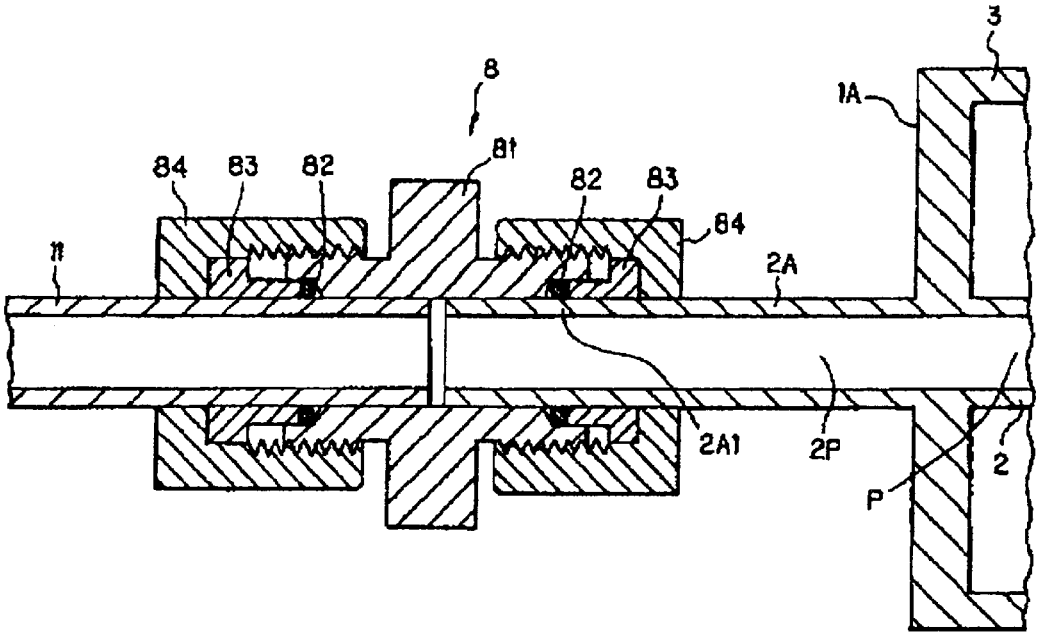
FIG. 2 An enlarged cross-sectional view of the coupler fitting of the dielectric-barrier discharge lamp device of this invention.
Figure 3:
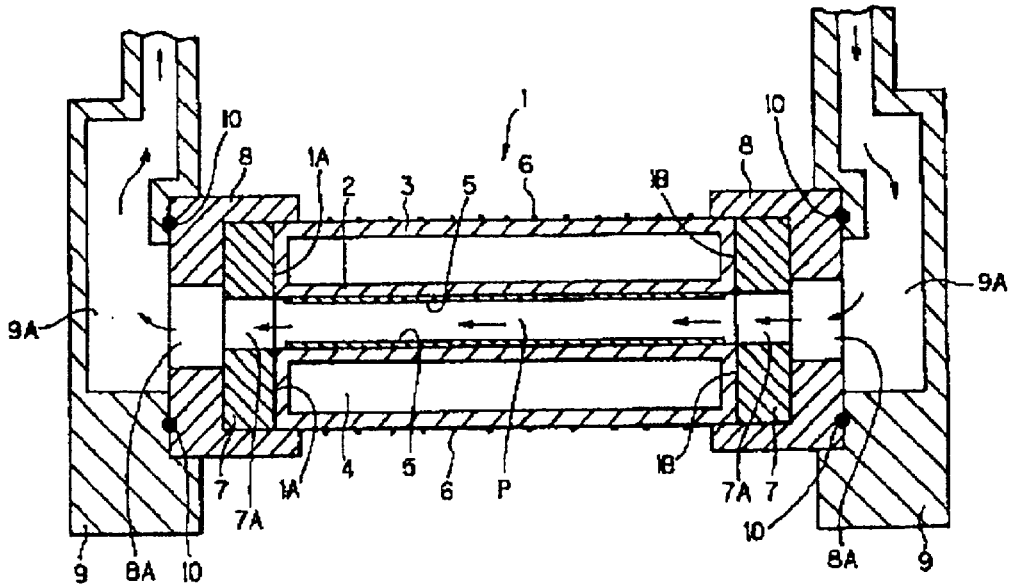
FIG. 3 (Prior Art)
FIG. 3 A cross-sectional view of a conventional dielectric-barrier discharge lamp device.

FIG. 2 is an enlarged view showing the relationship between the tube extension 2A and the coupler fitting 8. The coupler fitting 8 comprises a stainless steel body 81, fluorine polymer O-rings 82, iron-nickel alloy ferrules 83 and stainless steel cap nuts 84. This coupler fitting 8 connects the tube extension 2A to the guide tube 11 through which the coolant fluid flows.

The method of connecting the tube extension 2A and the coupler fitting 8 is as follows. The cap nut 84 is placed on the tube extension 2A in advance, and then the ferrule 83 is placed on the tube extension 2A so as to fit into the front of the cap nut 84. Then, the O-ring 82 is placed in front of the ferrule 83 so that it is in contact with the entire circumference of the tube extension 2A, after which the end 2A1 of the tube extension 2A is slid into the body 81 to which the guide tube 11 is connected. At this point, the cap nut 84 is pushed onto the body 81 and rotated so that the threads of the cap nut 84 engage the threads of the body 81. Thus, the O-ring 82 is deformed to create a tight fit between body 81 and ferrule 83, providing a tight hold on the outer periphery of the end 2A1 of the tube extension 2A.

In other words, because this is a structure in which the coupler fitting 8 holds tightly to the very smooth surface of the tube extension 2A that connects to the inner space P, it is possible to reliably prevent leakage of the coolant fluid used to cool the dielectric-barrier discharge lamp 1, and to reliably cool the dielectric-barrier discharge lamp 1.

The fluorine polymer O-ring 82 is completely enclosed by the stainless steel body 81, the iron-nickel alloy ferrule 83 and stainless steel cap nut 84. Therefore, the O-ring 82 is not directly illuminated by the vacuum ultraviolet radiation, which makes it possible to prevent deterioration of the O-ring 82 due to vacuum ultraviolet radiation. As a result, it is possible to prevent, over a long period, the leakage of the coolant fluid that cools the dielectric-barrier discharge lamp 1.

As shown in FIG. 1, the coupler fitting 8 is located on the tube extension 2A such that it is separated from the nearest end 1A by a distance L of, e.g., 10 mm, as shown. The reasons for leaving this space between the coupler fitting 8 and the end 1A of the discharge space 4 nearest to the coupler fitting 8 are as follows:

(1) The cap nut 84 and body 81 that make up the coupler fitting 8 are metal parts, and if the coupler fitting 8 were too close to the discharge space 4, there would be discharge between the external electrode 6 and the cap nut 84 or body 81, making it impossible to light the dielectric-barrier discharge lamp 1 or obtain the desired lamp performance.

(2) In the event that the tube extension 2A is a part of the inner tube 2, it will be made of quartz glass. This quartz glass has the characteristic of allowing the passage of vacuum ultraviolet radiation, and the vacuum ultraviolet radiation produced within the discharge space 4 will pass along the part of the tube extension 2A that is connected to the end 1A. Therefore, there would be some illumination of the O-ring 82 by vacuum ultraviolet radiation if it were in close contact with the outer circumference of the end 2A1 of the tube extension 2A, causing deterioration of the O-ring 82.

(3) Because there is mechanical contact between the cap nut 84, the body 81 and the ferrule 83 that make up the coupler fitting 8, a slight gap between parts is possible. Any vacuum ultraviolet radiation that made its way through such a gap and illuminated the O-ring 82 would cause deterioration of the O-ring.

For those reasons, the fixed space L is left between the coupler fitting 8 and the end 1A of the discharge space 4 of the dielectric-barrier discharge lamp 1 that is nearest to the coupler fitting 8. Specifically, in relation to the input power at which the dielectric-barrier discharge lamp is designed to operate, it is necessary that the minimum distance between the coupler fitting 8 and the end 1A that forms the discharge space 4 be at least 0.2 mm/W. If this distance is less than 0.2 mm/W, there is an increased possibility that the coupler fitting 8 and the end 1A that forms the discharge space 4 will be too close, thus causing the problems described above. Thus, for the above example where the distance between the coupler fitting 8 and the end 1A that forms the discharge space 4 is 10 mm, such a lamp would be operated with an input power of at most 50 W.

While a preferred embodiment in accordance with the present invention has been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

ACTION OF THE INVENTION

As described above, this invention provides a dielectric-barrier discharge lamp device having a dielectric-barrier discharge lamp with a hollow-cylinder-shaped discharge space formed by an outer tube that is roughly cylindrical in external shape and a co-axial inner tube, in which the inner tube has a cylindrical tube extension that extends outward from the discharge space, and in which the outer periphery of the end of the tube extension is held tightly by a coupler fitting connected to a guide tube through which a coolant fluid flows. In this way, the invention provides a dielectric-barrier discharge lamp device that can reliably prevent leakage of the coolant fluid used to cool the dielectric-barrier discharge lamp, and that can reliably cool the dielectric-barrier discharge lamp.

What we claim is:

1. A dielectric-barrier discharge lamp device comprising a dielectric-barrier discharge lamp having a hollow-cylinder-shaped discharge space formed between an outer tube that is roughly cylindrical in external shape and a co-axial inner tube; wherein the inner tube has a cylindrical tube extension that extends outward from the discharge space; and wherein an outer periphery of an end of the tube extension is held tightly by coupler fitting which is connected to a guide tube through which a coolant fluid flows; wherein said coupler fitting comprises a metal body, elastomeric O-rings, metal ferrules and metal cap nuts; wherein end portions of the tube extension and the guide tube are recieved in said metal body; wherein each of the metal ferrules is seated in a respective one of the cap nuts and each of the cap nuts is connected to a respective one of the tube extension and the guide tube in an axially adjustable manner; wherein each of the O-rings is mounted about a respective one of the tube extension and the guide tube within a respective end portion of the metal body is compressed into firm engagement with the respective one of the tube extension and the guide tube between a respective ferrule and the respective end portion of the metal body; and wherein a distance exists between the coupler fitting and the end of the discharge space between said tubes which is at least 0.2 mm/W, where W is the input power of the dielectric-barrier discharge lamp.

2. A dielectric-barrier discharge lamp device according to claim 1, wherein said distance is at least 10 mm.

3. A dielectric-barrier discharge lamp device comprising a dielectric-barrier discharge lamp having a hollow-cylinder-shaped discharge space formed between an outer tube that is roughly cylindrical in external shape and a co-axial inner tube; wherein the inner tube has a cylindrical tube extension that extends outward from each end of the discharge space; and wherein an outer periphery of an end of the tube extension at a first end of the discharge space is held tightly by a coupler fitting which is connected to a guide tube through which a coolant fluid flows into the tube extension at the first end of the discharge space, through the inner tube to the tube extension at an opposite end of the discharge space; and wherein a distance exists between the coupler fitting and an end of the discharge space between said tubes which is at least 0.2 mm/W, where W is the input power of the dielectric-barrier discharge lamp.

4. A dielectric-barrier discharge lamp device according to claim 3, wherein said distance is at least 10 mm.

5. A dielectric-barrier discharge lamp device comprising a dielectric-barrier discharge lamp having a hollow-cylinder-shaped discharge space formed between an outer tube that is roughly cylindrical in external shape and a co-axial inner tube; wherein the inner tube has a cylindrical tube extension that extends outward from an end of the discharge space; wherein an outer periphery of an outer end of the tube extension is held tightly by a coupler fitting which is connected to a guide tube through which a coolant fluid flows; and wherein a distance exists along said tube extension between the coupler fitting and the end of the discharge space which is at least 0.2 mm/W, where W is the input power at which the dielectric-barrier discharge lamp is adapted to operate.

6. A dielectric-barrier discharge lamp device according to claim 5, wherein said distance is at least 10 mm.

* * * * *